US009612559B2

(12) United States Patent
Shinagawa

(10) Patent No.: US 9,612,559 B2
(45) Date of Patent: Apr. 4, 2017

(54) IMAGE FORMING APPARATUS

(71) Applicant: Oki Data Corporation, Tokyo (JP)

(72) Inventor: Kazuki Shinagawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/160,045

(22) Filed: May 20, 2016

(65) Prior Publication Data

US 2016/0378037 A1 Dec. 29, 2016

(30) Foreign Application Priority Data

Jun. 24, 2015 (JP) ..... 2015-126357

(51) Int. Cl.
*G03G 15/00* (2006.01)

(52) U.S. Cl.
CPC ..... *G03G 15/5062* (2013.01); *G03G 15/6558* (2013.01)

(58) Field of Classification Search
CPC ..... G03G 15/5062; G03G 15/6558
USPC ..... 399/2
See application file for complete search history.

(56) References Cited

U.S. PATENT DOCUMENTS 9,122,220 B2 * 9/2015 Numazu ..... G03G 15/5062
2007/0166089 A1 * 7/2007 Cho ..... G03G 15/70 399/405
2012/0272850 A1 * 11/2012 Herrmann ..... B41J 11/46 101/481
2015/0172498 A1 * 6/2015 Inoue ..... H04N 1/00689 358/1.12
2015/0227105 A1 * 8/2015 Miyoshi ..... G03G 15/70 399/21
2015/0258778 A1 * 9/2015 Dooley ..... B41J 2/0057 347/103
2015/0336381 A1 * 11/2015 Kyoso ..... B41J 2/0451 347/14

FOREIGN PATENT DOCUMENTS

JP 2009-128547 A 6/2009

* cited by examiner

*Primary Examiner* — Susan Lee
(74) *Attorney, Agent, or Firm* — Rabin & Berdo, P.C.

(57) ABSTRACT

Provided is an image forming apparatus that includes a conveying section, an image forming section, a medium sensor, a mark printing section, and a controller. The conveying section is configured to convey a medium in a medium conveying direction. The image forming section is configured to form an image on the medium conveyed by the conveying section. The medium sensor is configured to perform detection of the medium conveyed by the conveying section. The mark printing section is configured to perform printing of a mark on the medium conveyed by the conveying section. The controller is configured to cause, based on a result of the detection by the medium sensor, the mark printing section to perform the printing of the mark on the medium, from a timing at which image formation on the medium by the image forming section is completed.

10 Claims, 10 Drawing Sheets

111

| PAGE NUMBER | PAGE LENGTH | GAP LENGTH | STAMP NUMBER | PRINTING STATE INFORMATION | MEDIUM POSITIONAL INFORMATION |
|---|---|---|---|---|---|
| PAGE DATA 233 | 100 mm | 3 mm | 233 | FIXED | PRINT COMPLETION GUARANTEE REGION (DISCHARGED) |
| PAGE DATA 234 | 100 mm | 3 mm | 234 | FIXED | PRINT COMPLETION GUARANTEE REGION (DISCHARGED) |
| PAGE DATA 235 | 100 mm | 3 mm | 235 | FIXED | PRINT COMPLETION GUARANTEE REGION (INSIDE APPARATUS) |
| PAGE DATA 236 | 100 mm | 3 mm | 236 | FIXING | FIXING REGION |
| PAGE DATA 237 | 100 mm | 3 mm | 237 | UNFIXED | TRANSFER REGION |
| PAGE DATA 238 | 100 mm | 3 mm | 238 | UNPRINTED | FEEDING REGION |
| ⋮ | ⋮ | ⋮ | ⋮ | ⋮ | ⋮ |
| PAGE DATA ··· | XXX mm | XXX mm | YYY | UNPRINTED | UNFED |

FIG. 4

103

SELECT STAMP NUMBER FROM WHICH REPRINTING IS TO BE STARTED

JAMMED PAGE:236

STAMP NUMBER [234]

STATE:PRINT COMPLETED, DISCHARGED

FIG. 7A

103

SELECT STAMP NUMBER FROM WHICH REPRINTING IS TO BE STARTED

| STAMP NUMBER | STATE |
|---|---|
| 234 | PRINT COMPLETED, DISCHARGED |
| 235 | STAYING INSIDE APPARATUS, PRINT··· |
| 236 | JAMMED PAGE |
| 237 | PRINTED-SURFACE UNFIXED |
| 238 | UNPRINTED |

FIG. 7B

103

SELECT STAMP NUMBER FROM WHICH REPRINTING IS TO BE STARTED

| STAMP NUMBER | STATE |
|---|---|
| 234 | PRINT COMPLETED, DISCHARGED |
| 235 | STAYING INSIDE APPARATUS, PRINT GUARANTEE NUMBER STAMPED, USABLE AFTER VISUAL CONFIRMATION |
| 236 | JAMMED PAGE, PRINTED-SURFACE UNFIXED, NO STAMP, CUT OFF AND DISCARD THE PAGE |
| 237 | PRINTED-SURFACE UNFIXED, NO STAMP |
| 238 | UNPRINTED |

FIG. 7C

IMAGE FORMING APPARATUS

CROSS REFERENCE TO RELATED APPLICATIONS

This application claims the benefit of Japanese Priority Patent Application JP 2015-126357 filed on Jun. 24, 2015, the entire contents of which are incorporated herein by reference.

BACKGROUND

The invention relates to an image forming apparatus that forms an image on a medium.

An image forming apparatus has been proposed that typically uses a first printer and a second printer to achieve duplex printing of paper. For example, reference is made to Japanese Unexamined Patent Application Publication No. 2009-128547. In such an image forming apparatus, an image is formed on a front surface of paper and a page number is printed on a back surface of the paper by the first printer, and the paper discharged from the first printer is reversed by a paper reversing device, and the reversed paper is then inserted into the second printer. An operator sees the page number printed on the back surface of the paper discharged from the first printer, thereby confirming the relationship between the page number and the image formed on the front surface.

SUMMARY

It is difficult for an operator to determine, only by confirming a mark (such as, but not limited to, a page number) printed on paper as a medium, whether the image formation on the confirmed paper has been completed.

It is desirable to provide an image forming apparatus that enables an operator to easily confirm completion of image formation by seeing a mark printed on a medium.

An image forming apparatus according to an illustrative embodiment of the invention includes: a conveying section configured to convey a medium in a medium conveying direction; an image forming section configured to form an image on the medium conveyed by the conveying section; a medium sensor configured to perform detection of the medium conveyed by the conveying section; a mark printing section configured to perform printing of a mark on the medium conveyed by the conveying section; and a controller configured to cause, based on a result of the detection by the medium sensor, the mark printing section to perform the printing of the mark on the medium, from a timing at which image formation on the medium by the image forming section is completed.

BRIEF DESCRIPTION OF THE DRAWINGS

FIG. 4 is a diagram illustrating a part of page information held by a memory.

FIGS. 7A to 7C are diagrams each illustrating a display example of an input screen of a display section when recovery printing is to be performed.

DETAILED DESCRIPTION

In the following, some example embodiments of the invention are described in detail with reference to the accompanying drawings. Note that the following description is directed to illustrative examples of the invention and not to be construed as limiting to the invention. Also, factors such as arrangement, dimensions, and a dimensional ratio of elements illustrated in each drawing are illustrative only and not to be construed as limiting to the invention.

First, a configuration of an image forming apparatus 100 is described.

Figure 1:
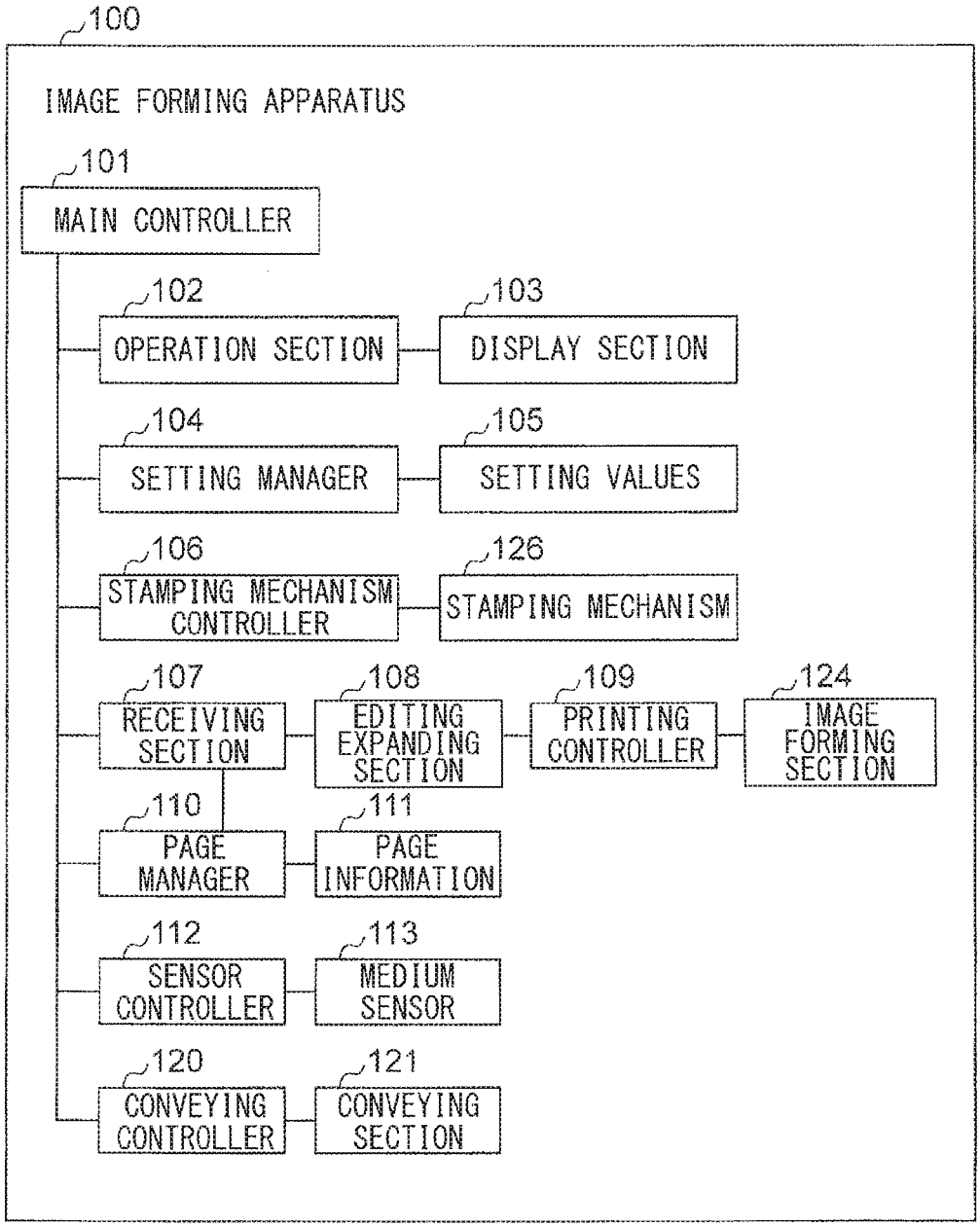
FIG. 1 is a block diagram illustrating a configuration of an image forming apparatus according to an example embodiment of the invention.

FIG. 1 is a block diagram illustrating a configuration of the image forming apparatus 100 according to an example embodiment of the invention.

The image forming apparatus according to the present example embodiment may be, for example, an electrophotographic label printer. In the present example embodiment, description is given of a case in which a medium 130 that is printed (image formed) by the image forming apparatus 100 may be a rolled paper medium (label roll paper) on which a plurality of labels 130*a* (base materials) are attached on a mount 130*b* (a release paper) at predetermined intervals. Note that the image forming apparatus 100 and the medium 130 are not limited to the examples described in the present example embodiment.

The image forming apparatus 100 may serve as a printer, and includes a main controller 101, a conveying section 121, an image forming section 124, a medium sensor 113, and a stamping mechanism 126. The conveying section 121 conveys a medium in a medium conveying direction. The image forming section 124 forms an image on the medium 130 conveyed by the conveying section 121. The medium sensor 113 detects the medium 130 conveyed by the conveying section 121. The stamping mechanism 126 may serve as a mark printing section in one embodiment, and prints a mark on the medium 130 conveyed by the conveying section 121.

The image forming apparatus 100 may further include an operation section 102, a display section 103, a setting manager 104, setting values 105, a stamping mechanism controller 106, a receiving section 107, an editing expanding section 108 (an image data processing section), a printing controller 109, a page manager 110, page information 111, a sensor controller 112, and a conveying controller 120. The stamping mechanism controller 106 may serve as a mark printing section controller.

The main controller 101 may serve as a controller in one embodiment, and may control the operation section 102, the display section 103 (an operation panel), the setting manager 104, the setting values 105, the stamping mechanism controller 106, the stamping mechanism 126, the receiving section 107, the editing expanding section 108, the printing controller 109, the image forming section 124, the page manager 110, the page information 111, the sensor controller 112, the medium sensor 113, the conveying controller 120, and the conveying section 121. For example, based on a result of detection by the medium sensor 113, the main controller 101 may cause the stamping mechanism 126 to print a mark (also referred to as stamping) on the medium 130, from a timing at which image formation on the medium 130 by the image forming section 124 is completed.

The operation section 102 may include a plurality of button switches and a plurality of input buttons. An operator (a user) of the image forming apparatus 100 may press down the button switch to select or change setting items displayed on the display section 103 or to cancel execution of printing. Also, the operator may optionally specify a page to be printed with use of the input buttons of the operation section 102.

The display section 103 may include, for example, a plurality of light-emitting diodes (LEDs) and one liquid crystal display (LCD), and turn on the LEDs based on the state of the image forming apparatus 100. The display section 103 may perform various displays on the LCD, and display positional information of the medium 130 (medium positional information) in the medium conveying direction, for example, based on the result of the detection by the medium sensor 113.

For example, the setting manager 104 may manage the plurality of setting values 105 held by a non-volatile memory. The setting values 105 may be, for example, a set of setting values of the plurality of setting items held by the non-volatile memory.

The setting manager 104 may manage, as one of the plurality of setting values 105, for example, a display mode (a recovery specifying method) of the display screen to be displayed on the display section 103 when reprinting after recovery from an error such as, but not limited to, jam (also referred to as recovery printing) is performed. The recovery specifying method when jam occurs may include, for example, absolute position specification and relative position specification. The absolute position specification may be a mode that allows for direct specification of a stamp number that corresponds to a page to be reprinted. The relative position specification may be a mode that displays a printing state of the page with an error and pages before and after the error page and allows for selection of a page to be reprinted from selectable pages, with reference to the page on which an error such as jam has occurred. The operator may previously set the recovery specifying method through, for example, the operation section 102.

The stamping mechanism controller 106 may control printing (stamping) of the mark by the stamping mechanism 126. The stamping mechanism 126 may serve as the mark printing section in one embodiment, and prints a mark on the medium 130 with use of, for example but not limited to, ink. The mark may include information (for example but not limited to, characters, symbols, and figures) indicating that the image forming section 124 completes the image formation on the medium 130. Also, the mark may include a number (for example but not limited to, a page number) indicating an order of the images formed on the medium 130. In the present example embodiment, description is given of an example where a page number is used as the mark.

For example, the stamping mechanism 126 may print the page on the medium 130 by, for example but not limited to, stamping. The page number may serve as the mark in one embodiment. The page number may be incremented (counted up) by the stamping mechanism controller 106, for example, every time the stamping mechanism 126 prints the page number on the medium 130 by stamping. The stamping mechanism controller 106 may associate the printed page number on the medium 130 with the printing page, thereby allowing for page management. Further, the stamping mechanism controller 106 may return the state of the stamping mechanism 126 to an initial state. For example, the stamping mechanism controller 106 may reset the counted-up page number to an initial value (for example, a page number "1").

The receiving section 107 may receive print data that is transmitted from an information processor (including, without limitation, a host device such as, but not limited to, a computer) coupled to the image forming apparatus 100 through communication lines such as, but not limited to, universal serial bus (USB) and local area network (LAN). The editing expanding section 108 may expand the print data acquired from the receiving section 107, into bitmap data to convert the print data into printable data. The printing controller 109 may transmit, to the image forming section 124, the bitmap data acquired from the editing expanding section 108.

The page manager 110 may manage information on pages of the print data (page information 111 described later) received by the receiving section 107. More specifically, the information on pages of the print data may be managed as the page information 111 by the page manager 110.

The page information 111 may include, for example but not limited to, the print data, the page number, a width of the medium 130 (a page length of a label 130*a*), and an interval between print regions (a length of a gap between the labels 130*a* adjacent to each other). The page information 111 may be held by, for example, a memory (such as, but not limited to, a non-volatile memory).

Note that the page information 111 may be held by the memory until the printing operation is normally completed, in consideration of the case where the recovery printing is performed. However, when the printing operation is cancelled by, for example but not limited to, instructions of the operator, the page information held by the memory may be deleted.

The sensor controller 112 may control detection of the medium 130 by the medium sensor 113. The sensor controller 112 may transmit, to the main controller 101, the detection result of the medium 130 by the medium sensor 113.

For example, a reflective sensor or a transmissive sensor may be used for the medium sensor 113. The medium sensor 113 may detect a boundary between the labels 130*a* adjacent to each other (a front end and a rear end of each label 130*a*). In a case where the mark is printed on a back surface of the medium 130, the use of a reflective sensor as the medium sensor 113 may be effective. For example, in a case of using paper, as the medium 130, in which print surfaces are separated from one another such as, but not limited to, die-cut paper, the use of a transmissive sensor as the medium sensor 113 may be effective. The use of either sensor, however, may allow for the detection of a front end and a rear end of the medium 130 (for example, both ends of the label 130*a*).

The conveying controller 120 may include a driving section and a transmission mechanism. The driving section may be a motor. The driving section may supply driving force. The transmission mechanism may transmit the driving force supplied from the driving section to the conveying section 121. The conveying controller 120 may control the conveying section 121, based on instruction from the main controller 101.

Figure 2:
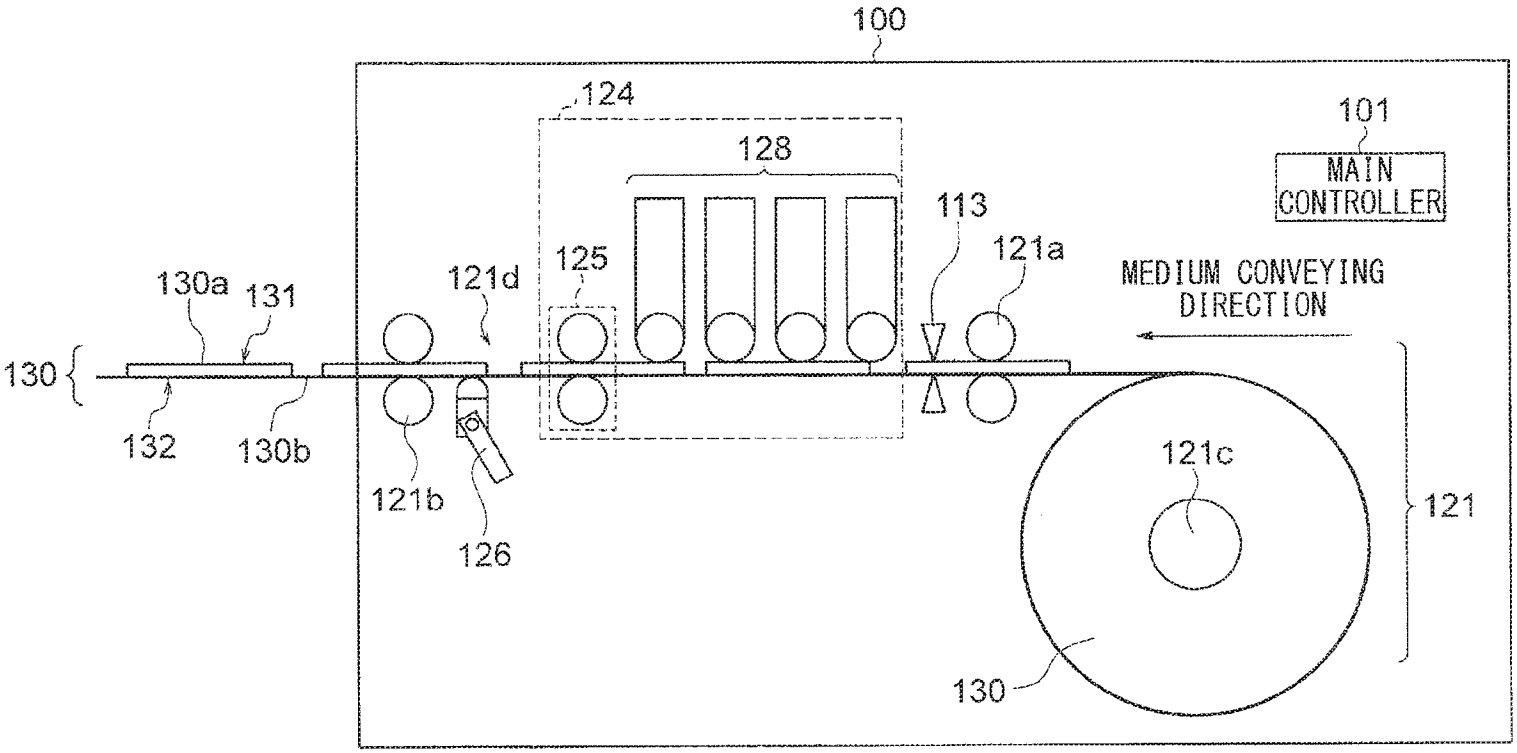
FIG. 2 is a longitudinal sectional diagram schematically illustrating an internal configuration of the image forming apparatus.

FIG. 2 is a longitudinal sectional diagram schematically illustrating an internal configuration of the image forming apparatus 100.

The conveying section 121 may include a first medium conveying roller 121*a*, a second medium conveying roller 121*b*, a medium supporting section 121*c*, and a medium conveying path 121*d*.

The first medium conveying roller 121*a* and the second medium conveying roller 121*b* each may be rotatably supported by an apparatus body, and convey the medium 130. The first medium conveying roller 121*a* and the second medium conveying roller 121*b* each may receive the driving force from the driving section through the transmission mechanism, thereby being rotationally driven. The driving section may be a motor. The transmission mechanism may be a gear.

The image forming section 124 may include a fixing device 125 and a plurality of toner cartridges 128. The image forming section 124 may form an image on the medium 130 through an electrophotographic system. The electrophotographic may involve the use of, for example but not limited to, an exposure member, a charging member, an image supporting member, and a developing member.

The fixing device 125 may include, for example, a pressure-applying roller and a heat roller, and fix the image formed on the medium 130 to the medium 130.

The toner cartridges 128 may contain their respective toners that are different in color from one another. Each of the toner cartridges 128 may be detachable from the image forming section 124.

The medium conveying path 121*d* may be a conveying path along which the medium 130 is to be conveyed. The medium conveying path 121*d* may include a plurality of conveying regions.

The medium supporting section 121*c* may rotatably support the medium 130 that may be a rolled paper medium in this example embodiment without limitation. The medium 130 may be fed by the first medium conveying roller 121*a* and may be thereafter conveyed by the second medium conveying roller 121*b*.

The medium 130 may include a first surface 131 and a second surface 132 that is on opposite side of the first surface 131. The image may be formed on the first surface 131 by the image forming section 124, and the mark may be printed on the second surface 132 by the stamping mechanism 126.

In the present example embodiment, without limitation, the medium 130 may be a rolled paper medium on which the plurality of labels 130*a* are attached with predetermined intervals on the mount 130*b*. Each of the labels 130*a* may have the first surface 131, and the mount 130*b* may have the second surface 132. In the present example embodiment, the image may be formed on the front surface of the label 130*a* as the first surface 131, and the mark may be printed on the front surface of the mount 130*b* (the rear surface of the medium 130) as the second surface 132. Non-limiting examples of the medium 130 may include a rolled print medium such as die-cut label paper, and continuous paper that allows for continuous printing.

In printing, a toner (i.e., a toner image) may be transferred on the medium 130 at the position of each of the toner cartridges 128 in FIG. 2, and the toner may be fixed to the medium 130 by the fixing device 125. The toner may serve as a developer. The stamping mechanism 126 may be disposed downstream of the fixing device 125 in the medium conveying direction (a feeding direction).

Next, some examples of arrangement and the stamp timing of the stamping mechanism 126 are described.

Figure 3A:
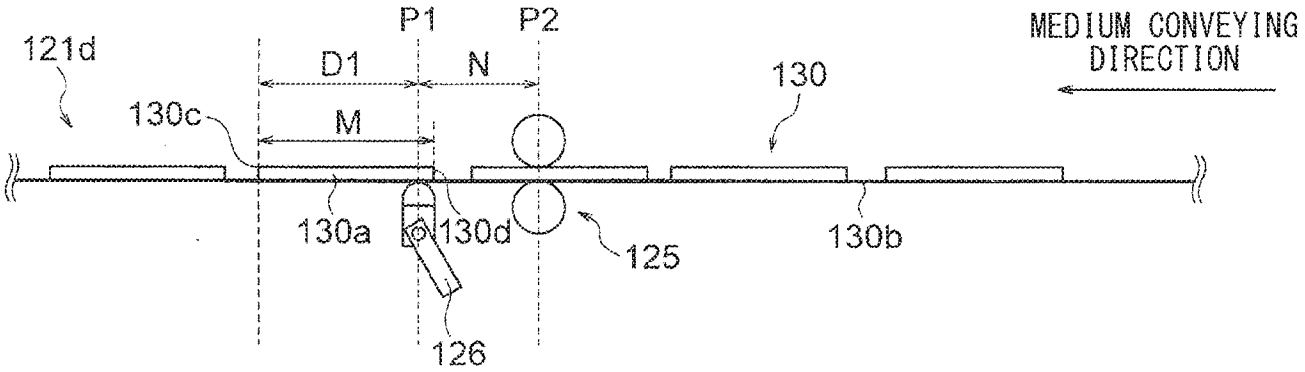
FIGS. 3A and 3B are longitudinal sectional diagrams each illustrating an example of stamp timing to a label.
Figure 3B:
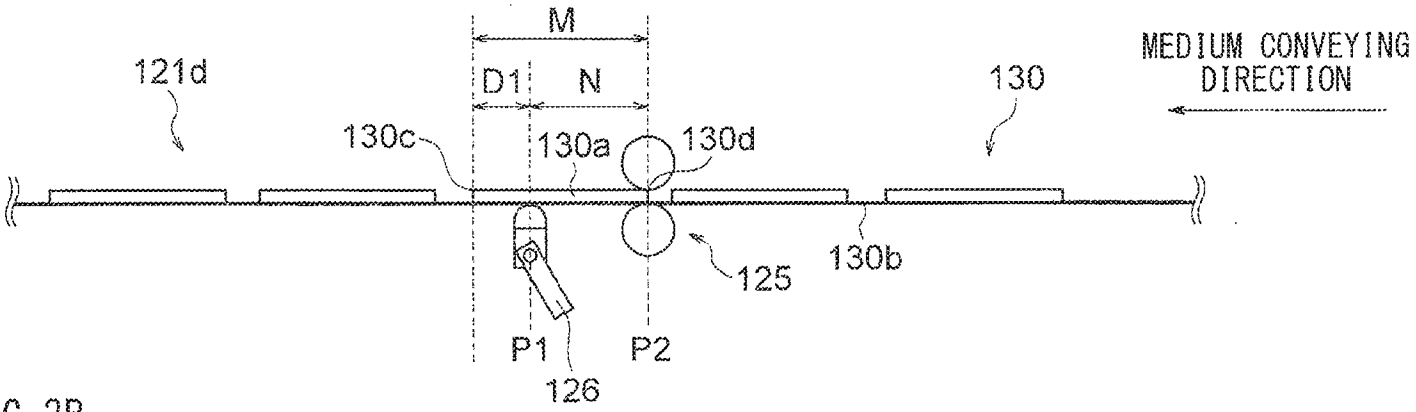

FIGS. 3A and 3B are longitudinal sectional diagrams each illustrating an example of the stamp timing to the label 130*a*. Also, FIGS. 3A and 3B each illustrate an example of positional relationship, inside the image forming apparatus 100, among: the medium 130 as seen from a direction orthogonal to the medium conveying direction; a stamp position P1 (a position where the stamping mechanism 126 is disposed); and a fixing position P2 (a position where fixing processing is executed by the fixing device 125) as a print completion position.

In FIGS. 3A and 3B, a distance D1 indicates a distance from the stamp position P1 to a front end 130*c* of the medium 130 (specifically, the label 130*a*) in the medium conveying direction. A page length M [mm] (a label length) indicates a length of the label 130*a* as the print region of the medium 130 in the medium conveying direction. A distance N [mm] indicates a distance from the fixing position P2 to the stamp position P1 on the medium conveying path 121*d*.

As illustrated in FIG. 3A, in the image forming apparatus 100 according to the present example embodiment, the stamping mechanism 126 may be disposed downstream of the image forming section 124 in the medium conveying direction. More specifically, the stamping mechanism 126 may be disposed downstream of the fixing device 125 in the medium conveying direction. In other words, the stamp position P1 may be located downstream of the fixing position P2 in the medium conveying direction (the feeding direction).

The main controller 101 may control, based on the result of the detection by the medium sensor 113, the stamping mechanism 126 to print the mark on the medium 130 at any timing. Any timing may be, for example but not limited to, from a timing at which the rear end 130*d* (the rear end of the print region of the medium 130) in the medium conveying direction of the medium 130 (specifically, the label 130*a*) has passed through the image forming section 124 (specifically, the fixing position P2) to a timing at which the medium 130, on which the image formation has been completed, is discharged to the outside of the image forming apparatus 100. More specifically, the main controller 101 may control the mark printing timing (stamp timing) by the stamping mechanism 126 through the stamping mechanism controller 106.

In one example illustrated in FIG. 3A, after the front end 130*c* of the label 130*a* passes through the stamp position P1, the page number may be printed by stamping on the back surface of the medium 130 (the mount 130*b*) near the rear end 130*d* of the label 130*a*. At the time when the page number is printed on the medium 130 by stamping, the stamped medium 130 (the mount 130*b*) has already passed through the fixing position P2. As illustrated in FIG. 3A, executing the stamping at least at or after a timing at which the fixing processing by the fixing device 125 is completed (at timing when the fixing processing is completed) allows the mark (i.e., the page number) printed on the medium 130 to have a function as a confirmation mark guaranteeing that the image formation by the image forming section 124 has been completed (print quality assurance).

In one example illustrated in FIG. 3B, the stamping is executed at timing when the rear end 130*d* of the label 130*a* is located at the fixing position P2. The mark may be printed on the medium 130 (the mount 130*b*) at the time when the rear end 130*d* of the label 130*a* is located on the fixing position P2, which makes it possible to guarantee completion of the image formation on the medium 130 printed with the mark (the image formation on the label 130*c*) even if a print error such as jam occurs immediately after the rear end 130*d* of the label 130*a* has passed through the fixing position P2.

As mentioned above, the stamping may be executed at any timing (the stamp range) from a timing at which the front end 130*c* of the label 130*a* has travelled by the distance D1 [mm] from the stamp position P1 as a reference to a timing at which the front end 130*c* of the label 130*a* travels by a distance M [mm] from the stamp position P1 as the reference. In other words, the timing of executing the stamping (the stamp range) may be any timing that satisfies a condition expressed by $(M-N) \leq D1 \leq M$. When the stamp range satisfies the condition, it is possible to guarantee completion of the image formation of the medium 130 (the label 130*a*) printed with the mark. Accordingly, it is possible for the operator to determine completion of the image formation on the page (the label 130*a*) printed with the mark by seeing the mark printed on the medium 130.

Setting of the timing of executing the stamping (the position where the mark is to be printed) may be changed by the operator through the operation section 102. When the setting is changed through the operating section 102, the changed setting may be stored in the setting manager 104.

FIG. 4 is a diagram illustrating a part of the page information 111 held by the memory.

Figure 5:
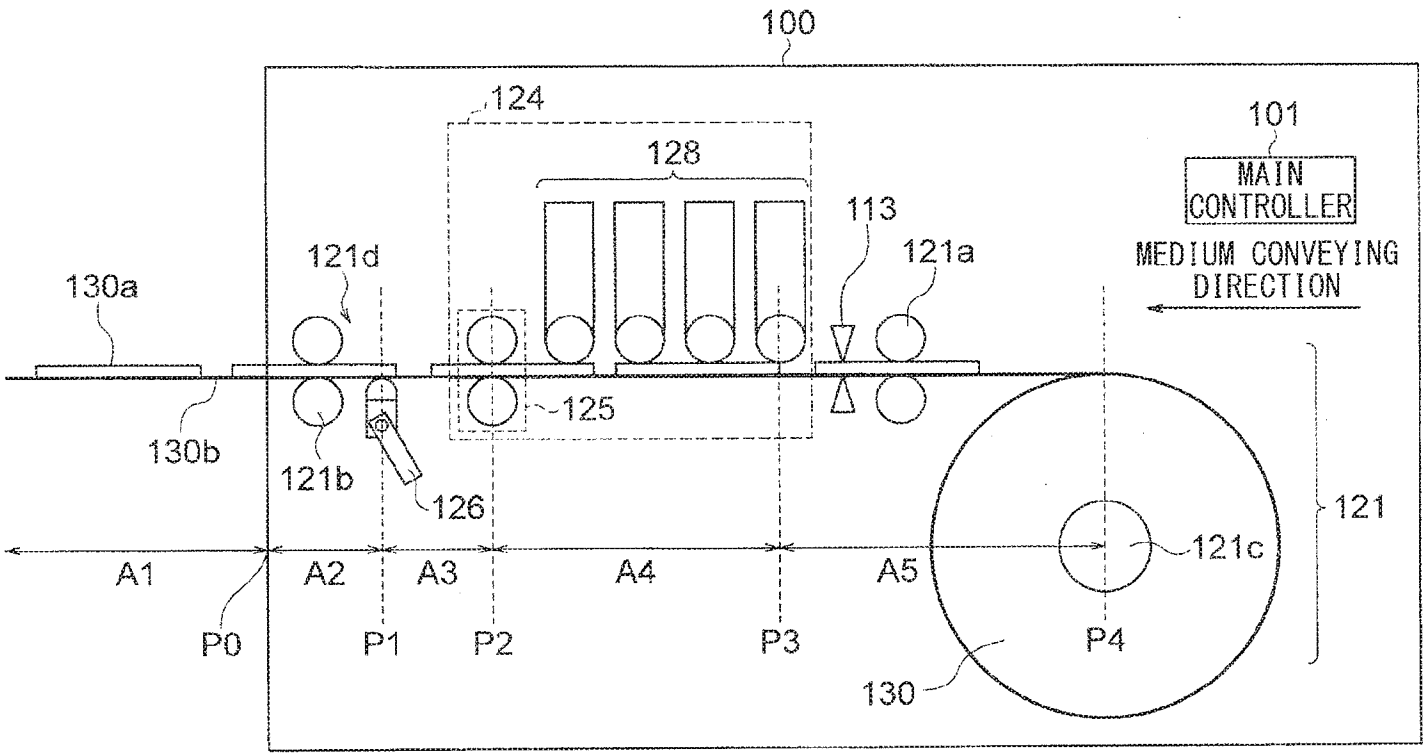
FIG. 5 is a longitudinal sectional diagram illustrating a plurality of conveying regions in a medium conveying path.

FIG. 5 is a longitudinal sectional diagram illustrating a plurality of conveying regions of the medium conveying path 121*d*.

In one example illustrated in FIG. 4, the page information 111 may include, for example but not limited to, the page number (the page data number), the page length, the gap length, the stamp number, printing state information, and medium positional information.

"Page number" included in the page information 111 may be, for example, a consecutive number corresponding to the image to be formed on the medium 130 (the print data to be printed on the labels 130*a*).

"Page length" included in the page information 111 may indicate the length of the medium 130 in the medium conveying direction. In the present example embodiment, without limitation, "page length" may correspond to the label length of the label 130*a* in the medium conveying direction.

"Gap length" included in the page information 111 may indicate an interval between the medium 130 and the medium 130 adjacent to each other. In the present example embodiment, "gap length" may indicate the interval between the labels 130*a* adjacent to each other.

"Stamp number" included in the page information 111 may indicate the mark to be printed on the medium 130 by the stamping mechanism 126. In the present example embodiment, without limitation, the mark to be printed on the medium 130 may be set to "stamp number" that uses a consecutive number. Also, in the present example embodiment, the stamp number may be set to the consecutive number coincident with the page number; however, both numbers may be not necessarily coincident with each other.

The stamp number may be cleared (reset to number "1") by the operator through the operating section 102. Alternatively, the stamp number may be so set as to be automatically reset at any timing, for example, when the medium 130 is replaced, or when a cover of the image forming apparatus 100 is opened or closed.

In the present example embodiment, since the stamp number is coincident with the page number, the user may specify the stamp number through the operation section 102 to start reprinting of the page (the label 130*a*) corresponding to the specified stamp number and following pages.

"Printing state information" included in the page information 111 may indicate the progress (printing state) of the image formation on the medium 130 and may be used as information to be displayed on the display section 103. For example, the printing state information may be updated to "unprinted" in a state before the image formation by the image forming section 124 is executed (when the medium 130 is located upstream of the image forming section 124 in the medium conveying direction). The printing state information may be updated to "unfixed" in a state where the image formation by the image forming section 124 has been completed and before the fixing processing is executed (when the medium 130 on which the image has been formed is located between the image forming section 124 and the fixing device 125). The printing state information may be updated to "fixing" in a state where the fixing processing by the fixing device 125 is being executed (in a state where the medium 130 on which the image has been formed is passing through the fixing device 125). The printing state information may be updated to "fixed" in a state where the fixing processing by the fixing device 125 has been completed (when the medium 130 on which the image has been formed has passed through the fixing device 125).

"Medium positional information" included in the page information 111 may indicate the position of the medium 130 in the medium conveying path, and may be used as information to be displayed on the display section 103. For example, the medium positional information of each page (each label 130*a*) of the medium 130 may be updated based on the positions of the front end 130*c* and the rear end 130*d* of the medium 130 (the label 130*a*).

The operator may refer to the printing state information and the medium positional information displayed on the display section 103 to know the state (the state of each page recognized by the image forming apparatus 100) of each page (each label 130*a*) of the medium 130 in the image forming apparatus 100.

In the present example embodiment, without limitation, the medium positional information from the feeding of the medium 130 by the first medium conveying roller 121*a* to exiting of the medium 130 from the inside of a fixing region A3 (i.e., to a timing at which the front end 130*c* reaches the stamp position P1) may be updated based on the position of the front end of each page of the medium 130 (the front end 130*c* of each label 130*a*) as a reference. The medium positional information where the medium 130 is located in a print completion guarantee region (inside apparatus) A2 and a print completion guarantee region (discharged) A1 may be updated based on the position of the rear end of each page of the medium 130 (the rear end 130*d* of each label 130*a*) as a reference. For example, the medium positional information may be updated from "transfer region" to "fixing region" at a time when the front end 130*c* of the label 130*a* enters the fixing region A3 from a transfer region A4, and the medium positional information may be updated from "fixing region" to "print completion guarantee region (inside apparatus)" at a time when the rear end 130*d* of the label 130*a* passes through the stamp position P1.

The print completion guarantee region (discharged) A1 may indicate a region outside the image forming apparatus 100 (for example, a discharge tray attached to the image forming apparatus 100). The print completion guarantee region (inside apparatus) may indicate a region between a cover position P0 at which the housing of the image forming apparatus 100 is located and the stamp position P1 at which the stamping mechanism 126 is disposed. The fixing region A3 may indicate a region between the stamp position P1 and the fixing position P2 at which the fixing device 125 is disposed. The transfer region A4 may indicate a region between the fixing position P2 and a transfer position P3 that is a position at which the image is first transferred on the medium 130 by the image forming section 124. A feeding region A5 may indicate a region upstream of the transfer position P3 in the medium conveying direction. "Unfed" in the medium positional information may indicate a case where the medium 130 is not fed. For example, "Unfed" in the medium positional information may indicate a case where the medium sensor 113 does not detect the medium 130.

For example, when the feeding region A5 is displayed as the medium positional information on the display section 103, the operator is able to determine, based on the page information 111 illustrated in FIG. 4, that the transfer processing on the medium 130 located in the feeding region A5 (for example, the label 130*a* of the 238th page illustrated in FIG. 4) is not started. In this state, when jam occurs during the transfer processing of the 237th page (the print data of page data 237), the medium 130 of the 237th page (the label 130*a* located in the transfer region A4) on which the transfer processing is uncompleted may be discarded, following which reprinting may be started to print the print data of the page data 237 on the medium 130 (the label 130*a*) of the 238th page.

Figure 6:
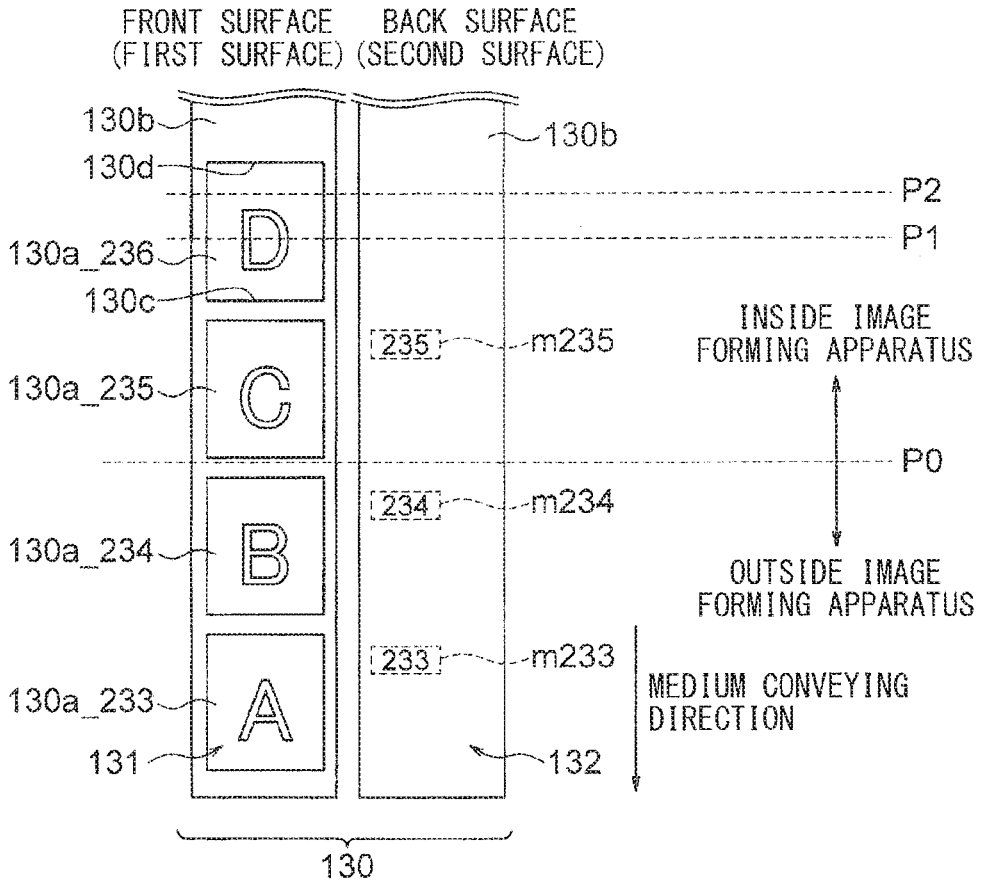
FIG. 6 is a diagram illustrating an example of a state of a front surface (a first surface) and a back surface (a second surface) of a medium when paper jam occurs in printing.

FIG. 6 is a diagram illustrating an example of the state of the front surface (the first surface 131) and the back surface (the second surface 132) of the medium 130 in a case where paper jam occurs in printing.

One example illustrated in FIG. 6 may be an example where paper jam has occurred in printing of the medium 130 (the label 130*a*) of the 236th page from printing start (at a time before the rear end 130*d* of the label 130*a* of the 236th page passes through the fixing position P2). Note that the page information 111 including the page number, the stamp number, the printing state information, the medium positional information, and other information of the medium 130 (each label 130*a*) illustrated in FIG. 6 may correspond to the page information 111 illustrated in FIG. 4.

A label 130*a*_233 of the 233rd page and a label 130*a*_234 of the 234th page have been respectively printed with stamps m233 and m234, and have been already discharged to the outside of the image forming apparatus 100. A label 130*a*_235 of the 235th page has been printed with a stamp m235 and subjected to the fixing processing, but is located inside the image forming apparatus 100. A label 130*a*_236 of the 236th page is being printed (in a state before the rear end 130*d* of the label 130*a*_236 passes through the fixing position P2) and has not been printed with a mark.

FIGS. 7A to 7C are diagrams each illustrating a display example of the input screen of the display section 103 in a case where recovery printing is performed. The displayed contents of the display section 103 illustrated in FIGS. 7A to 7C respectively correspond to the states (the page information 111) of the mediums 130 (the respective labels 130*a*) illustrated in FIG. 6. The input screen for giving instructions on the recovery printing may be displayed on the display section 103 at timing when, for example, the operator clears error display such as jam.

FIG. 7A is a display example of the display section 103 in a case where the recovery specifying method is set to the absolute position specification. In one example illustrated in FIG. 7A, the page number (the stamp number) "236" of the medium 130 (the label 130*a*) on which the jam has occurred and the state "JAM occurred page" are illustrated. In a case where the display mode of the display section 103 is set to the absolute position specification, the operator may directly input the stamp number (the page number) to specify the page from which the reprinting is to be started while referring to the display of the display section 103.

For example, the printing state information ("state") of the page information 111 may be displayed on the display section 103. In one example illustrated in FIG. 7A, the stamp number "234" may be inputted and the state "print completed and discharged" of the medium 130 (the label 130*a*_234 of the 234th page) corresponding to the stamp number "234" may be displayed. When the stamp number is changed, the state of each page (the label 130*a*) of the medium 130 corresponding to the changed stamp number may be displayed.

FIG. 7B is a display example of the display section 103 in a case where the recovery specifying method is set to the relative position specification. In one example illustrated in FIG. 7B, the printing state information ("state") of the stamp number (the page number) "236" of the page on which jam has occurred and stamp numbers "234" to "238" before and after the jammed page may be displayed on the display section 103. In a case where the display mode of the display section 103 is set to the relative position specification, the operator may easily know the states of the pages around the page on which the jam has occurred (the states of the respective pages recognized by the image forming apparatus 100).

When the printing state information ("state") displayed on the display section 103 is different from the actual state that is acquired from the back surface (the stamp number) of the medium 130 seen by the operator, the reprinting may be started from the page that has not been properly printed due to jam or other factors, by specifying the proper stamp number.

The displayed contents of the display section 103 illustrated in FIG. 7C may correspond to the displayed contents of the display section 103 illustrated in FIG. 7B. The printing state information ("state") in the page information 111 that cannot be displayed on the display section 103 of FIG. 7B may be displayed on the display section 103 of FIG. 7C. For example, in one example illustrated in FIG. 7B, information on the medium 130 of the stamp number "236" that, for example: the page is a jammed page in printing; the fixing processing on the page has not been completed; and the mark has not been printed on the page. As illustrated in FIG. 7B, for example, when all contents of "state" corresponding to each stamp number cannot be displayed on the panel of the display section 103 at a time, ticker display of the contents may be performed to provide the operator with all of the displayed contents.

As illustrated in FIGS. 7B and 7C, when the selection of the stamp number is changed through button operation of the operation section 102, the states of the respective pages corresponding to the stamp numbers before and after the changed stamp number may be displayed on the display section 103. The stamp number "236" may be currently selected in FIG. 7B. For example, when the stamp number "235" is selected through button operation, the displayed contents of the display section 103 may be updated, and the states of the respective pages corresponding to the stamp numbers before and after the stamp number "235" (for example, the states of the respective pages corresponding to the stamp numbers "233" to "237") may be displayed on the display section 103.

Next, basic operation of the image forming apparatus 100 in image formation is described.

Figure 8:
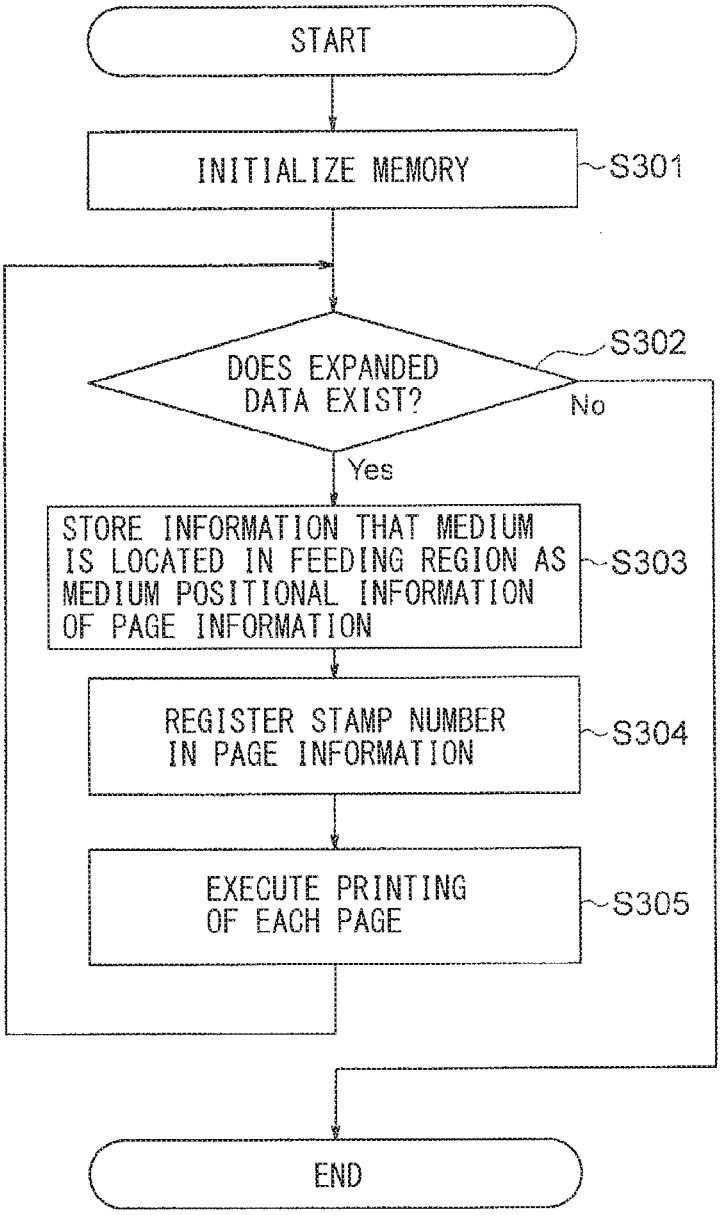
FIG. 8 is a flowchart illustrating an example of print control operation of the image forming apparatus.

FIG. 8 is a flowchart illustrating an example of print control operation of the image forming apparatus 100.

Upon start of the printing operation of the image forming apparatus 100, first, memory that holds information necessary for printing (for example, a memory region of the page information 111) may be initialized (step S301). The data to be initialized may include, for example but not limited to, the page number for management of the page to be printed, and the print data length and the print data width both indicating the size of the data to be printed.

At step S302, the main controller 101 may confirm, with use of the page manager 110, whether the expanded print data (the page information 111) exists.

When the expanded print data (expanded data) does not exist (No at step S302), printing may not be started and processing may be terminated. When the expanded print data exists (Yes at step S302), the main controller 101 may acquire the expanded page information 111 to set the positional information of the medium 130 (hereinafter, referred to as "medium positional information") in the acquired page information 111 as the "feeding region" (step S303).

The main controller 101 may register the number to be stamped (the stamp number) in the page information 111 (step S304). Registering and storing the stamp number in the page information 111 makes it possible to associate, with the stamp number, various pieces of information for each page of the medium 130 before printing until completion of the printing. The various pieces of information as used herein may refer to the expanded print data, the page number, the printing state information, and the medium positional information. Associating such various pieces of information with the stamp number allows for searching, based on the stamp number, of the various pieces of information in a case where an error such as jam occurs on the image forming apparatus 100, and thereby allows for execution of recovery printing. Note that the various pieces of information are not limited to those described above. Any information or data may be utilized, on an as-needed basis, as the various pieces of information to be associated with the stamp number.

At step S305, the image forming apparatus 100 may start printing of each page in response to printing activation of the main controller 101. After printing of a page is started, the process may return to step S302 and a confirmation may be performed as to whether the expanded data of the next page exists.

Next, description is given of update processing of the medium positional information displayed on the display section 103 after the printing operation by the image forming apparatus 100 is started.

Figure 9:
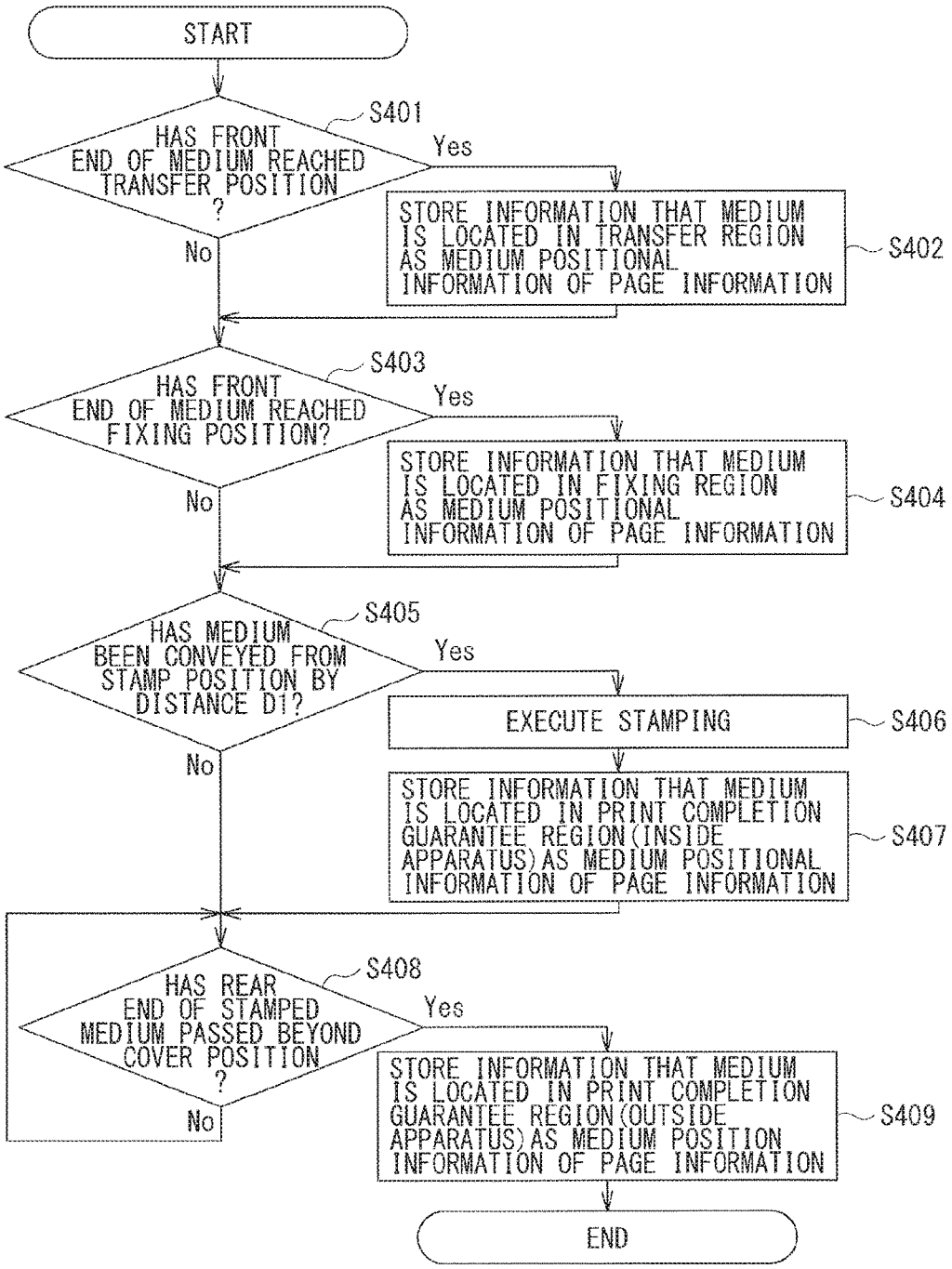
FIG. 9 is a flowchart illustrating update processing of medium positional information displayed on the display section after start of printing.

FIG. 9 is a flowchart illustrating the update processing of the medium positional information displayed on the display section 103 after start of printing.

Upon the start of the printing operation by the image forming apparatus 100, first, the medium 130 may be conveyed by the first medium conveying roller 121*a*. The main controller 101 may determine whether the front end 130*c* of the medium 130 (the front end 130*c* of the label 130*a* to be printed) in the medium conveying direction has reached the transfer position P3 (step S401). For example, when the medium 130 is fed, the front end 130*c* of the medium 130 in the medium conveying direction may be detected by the medium sensor 113 at a time when the medium 130 (the label 130*a*) passes through the medium sensor 113. The conveying distance from the position of the medium sensor 113 (the medium detected position) may be calculated to determine whether the front end 130*c* of the medium 130 has reached the transfer position P3. Note that the transfer position P3 may be, for example but not limited to, a first transfer position of the plurality of transfer positions in the image forming section 124.

When it is determined at step S401 that the front end 130*c* of the medium 130 has reached the transfer position P3 (Yes at step S401), the medium positional information of the page information 111 may be changed from "feeding region" to "transfer region" (step S402). Display of "transfer region" on the display section 103 enables the user to know the (unfixed) state in which the page displayed as "transfer region" (the label 130*a*) has not been subjected to the fixing processing by the fixing device 125.

When it is determined at step S401 that the front end 130*c* of the medium 130 has not reached the transfer position P3 (No at step S401), the medium positional information of the page information 111 may not be changed because the state (the position) of the medium 130 has not been changed.

At step S403, the main controller 101 may determine whether the front end 130*c* of the medium 130 has reached the fixing position P2. When it is determined that the front end 130*c* of the medium 130 has reached the fixing position P2 (Yes at step S403), the medium positional information of the page information 111 may be changed from "transfer region" to "fixing region" (step S404).

There is a case where a part on which the fixing has been completed and a part on which the fixing has not been completed are mixed in the label 130*a* passing through the fixing position P2 while the page to be printed (the label 130*a*) is passing through the fixing position P2. The regions before and after the fixing position P2 of the medium conveying path 121*d* may be segmented into the transfer region A4 and the fixing region A3. In the case where the image is formed only in the region on the front end 130*c* side of the label 130*a* in the medium conveying direction, even when an error occurs during the fixing processing and the image formation operation is accordingly stopped, the operator may confirm completion of the image formation by seeing the printed surface (the first surface 131).

When it is determined at step S403 that the front end 130*c* of the medium 130 has not reached the fixing position P2 (No at step S403), the medium positional information of the page information 111 may not be changed because the state (the position) of the medium 130 has not been changed.

At step S405, the main controller 101 may determine whether the front end 130*c* of the medium 130 has reached a position separated away from the stamp position P1 by the distance D1 in the medium conveying direction. In the present example embodiment, the distance D1 may be set to M [mm]−N [mm], where M [mm] refers to the label length in the medium conveying direction and N [mm] (N<M) refers to the distance from the fixing position P2 to the stamp position P1 in the medium conveying direction. Note that, for example, the distance D1 may be set within a region that satisfies an expression of (M−N) [mm]≤D1≤M [mm].

When it is determined that the front end 130*c* of the medium 130 has reached the position separated away from the stamp position P1 by the distance D1 in the medium conveying direction (Yes at step S405), the main controller 101 may determine that the fixing processing on the page to be printed (the label 130*a*) has been completed, and may issue instructions for stamping by the stamping mechanism 126, to the stamping mechanism controller 106 (step S406).

The stamping mechanism 126 may execute stamping under the control of the stamping mechanism controller 106 (step S406).

When the stamping is executed at step S406, the page manager 110 may change the medium positional information of the page information 111 from "fixing region" to "print completion guarantee region (inside apparatus)" (step S407). Note that the page manager 110 may change the medium positional information, based on passage of the rear end 130*d* of the label 130*a* through the fixing position P2.

When it is determined that the front end 130*c* of the medium 130 has not reached the position separated away from the stamp position P1 by the distance D1 in the medium conveying direction (No at step S405), the medium positional information of the page information 111 may not be changed because the state (the position) of the medium 130 has not been changed.

At step S408, the main controller 101 may determine whether the rear end 130*d* of the medium 130 (the label 130*a* on which the image formation has been completed) in the medium conveying direction has passed beyond the cover position P0 (from the inside to the outside of the apparatus body). When it is determined that the rear end 130*d* of the medium 130 has passed beyond the cover position P0 (Yes at step S408), the page manager 110 may change the medium positional information of the page information 111 from "print completion guarantee region (inside apparatus)" to "print completion guarantee region (discharged)" (step S409).

When it is determined that the rear end 130*d* of the medium 130 has not passed beyond the cover position P0 (No at step S408), the medium positional information of the page information 111 may not be changed because the state (the position) of the medium 130 has not been changed.

Next, description is given of operation of recovery printing (also simply referred to as "recovery") in a case where an error such as jam occurs on the image forming apparatus 100.

Figure 10:
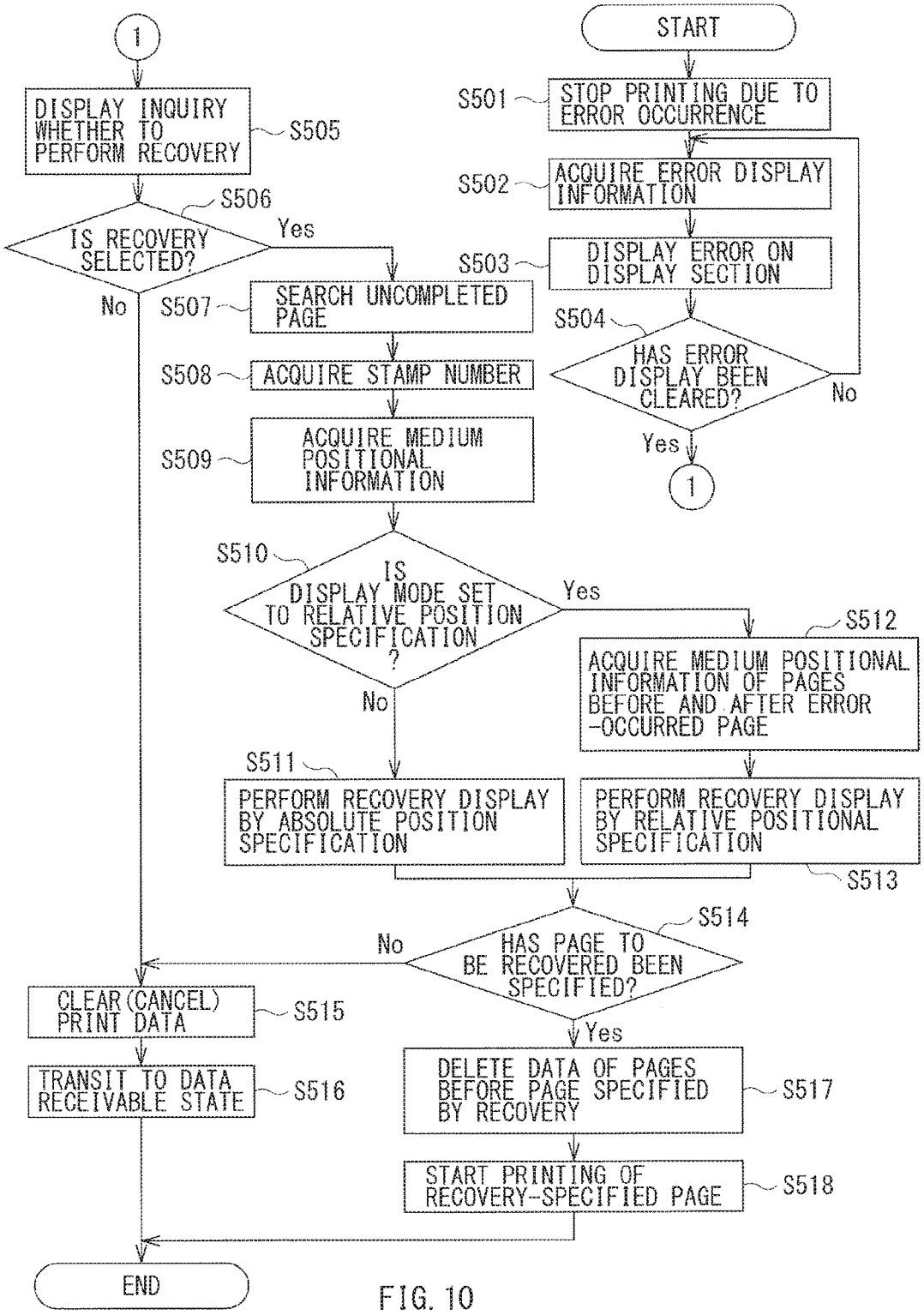
FIG. 10 is a flowchart illustrating recovery control flow when an error occurs on the image forming apparatus.

FIG. 10 is a flowchart illustrating recovery control flow in a case where an error has occurred on the image forming apparatus 100.

When an error such as jam occurs in printing, the image forming apparatus 100 may stop printing, and error information (error display information) may be displayed on the display section 103. The main controller 101 may perform the error display until the operator clears the error display. When the error display is cleared, the main controller 101 may display an input screen for the recovery printing.

When an error occurs, the image forming apparatus 100 may stop printing (step S501). The main controller 101 may acquire information on occurred error (step S502), and may perform the error display on the display section 103 (step S503).

At step S504, the main controller 101 may determine whether the error display has been cleared by the operator. When it is determined that the error display has not been cleared (No at step S504), the process may return to step S502, and the error information may be displayed on the display section 103 until the error display is cleared (steps S502 and S503).

When it is determined that the error display has been cleared (Yes at step S504), an inquiry (an input screen) as to whether to perform the recovery printing may be displayed on the display section 103 (step S505).

The operator may confirm the stamp number by, for example, seeing the back surface (the second surface 132) of the medium 130 located at the print completion guarantee region (inside apparatus) A2 and the print completion guarantee region (discharged) A3. The operator may select (may input), through the operation section 102, whether to perform the recovery printing, for example, based on confirmation of the stamp number.

The main controller 101 may determine whether the recovery printing is selected in the inquiry of step S505 (step S506). When the recovery printing is not selected (No at step S506), the main controller 101 may clear the print data (step S515) and may transit to data receivable state (a state of waiting for print instruction) (step S516).

When the recovery printing is selected (Yes at step S506), the main controller 101 may search the medium 130 that has been being printed (the label 130*a* on which the fixing processing has not been completed) from the page information 111 managed by the page manager 110 (step S507). The main controller 101 may perform the searching in order to acquire the page information 111 (the page information 111 of the page on which the error has occurred) corresponding to the position at which the error has occurred (for example, the label 130*a* on which paper jam has occurred) on the medium conveying path 121*d*.

The main controller 101 may acquire the stamp number from the page information 111 acquired at step S507 (step S508). In addition, the main controller 101 may acquire the medium positional information from the page information 111 acquired at step S507 (step S509).

After acquiring the page information 111 (the stamp number and the medium positional information) of the page on which the error has occurred, the main controller 101 may confirm the display mode of the recovery specifying method set in the setting manager 104, and determine whether the set display mode is the relative position specification (step S510).

When it is determined at step S510 that the display mode of the recovery specifying method is not set to the relative position specification (No at step S510), the recovery specification display by the absolution position specification may be performed, and the page information 111 acquired at steps S508 and S509 may be displayed on the display section 103 (step S511).

When it is determined at step S510 that the display mode of the recovery specifying method is set to the relative position specification (Yes at step S510), the main controller 101 may acquire the page information 111 of the pages before and after the page of the page information 111 that has been acquired at steps S508 and S509 (step S512). Any number of pages may be set for the number of pages to be acquired.

When the page information 111 is acquired at step S512, the recovery specification display by the relative position specification may be performed, and the page information 111 acquired at step S512 may be displayed on the display section 103 (step S513).

To instruct the recovery printing, the operator may input the stamp number corresponding to the page on which the recovery printing is to be started (the recovery page) through the operation section 102 (specification of the recovery page).

The main controller 101 may determine whether the operator has specified the recovery page through the operation section 102 (step S514).

When it is determined at step S514 that the recovery specification (specification of the recovery page) has not been inputted (No at step S514), the main controller 101 may clear the print data (the page information 111) (step S515), and the state may be transited to the data receivable state (the state of waiting for print instruction) (step S516).

When it is determined at step S514 that the recovery specification has been inputted (Yes at step S514), the main controller 101 may determine that the printing of the pages before the page specified by the recovery specification has been properly completed (the fixing processing has been completed), and may delete the page information 111 of the pages before the page specified by the recovery specification (step S517).

After the page information 111 of the pages before the page specified by the recovery specification is deleted at step S517, the printing of the page specified by the recovery specification (the recovery printing) may be restarted (step S518).

According to the image forming apparatus 100 of the present example embodiment, it is possible for the operator to easily confirm completion of the image formation by seeing the mark printed on the medium 130.

The mark may be printed on the medium 130 from the timing at which the rear end of the medium 130 (for example, the rear end 130*d* of the label 130*a*) has passed through the image forming section 124. Thus, it is possible to guarantee completion of the image formation on the medium 130 (the label 130*a* to be printed) printed with the mark.

Even when the medium 130 on which the image formation has been completed (for example, the label 130*a* to be printed) is stayed inside the image forming apparatus 100 due to occurrence of jam or other factors, it is possible for the operator to confirm the printing state of the medium 130 that has not been discharged to the outside of the image forming apparatus 100 by confirming whether the mark has been printed on the medium 130.

In a case where the stamp number is used as the mark, it is possible for the operator to accurately specify the page number (the print data) to be subjected to the reprinting (the recovery printing) by confirming the stamp number printed on the medium 130 on which the image formation has been completed. In other words, for example, it is possible to start the reprinting from the page on which the image formation has not been properly completed due to jam or other factors.

In a case where a rolled paper medium is used as the medium 130 and the stamp number is used as the mark, it is possible to know the residual amount of the medium 130 (for example, the number of remaining labels 130*a*) easily through confirmation of the stamp number printed on the medium 130.

In the present example embodiment, one example in which the electrophotographic label printer is applied to the image forming apparatus 100 has been described; however, the image forming apparatus 100 is not limited to the electrophotographic label printer. For example, an inkjet printer, a thermal transfer printer using an ink ribbon, a thermal label printer (a thermosensitive printer) using a thermal paper as the medium 130, and any other printer that uses an alternative printing method may be applied to the image forming apparatus 100. For example, in a case where a thermal transfer printer is used as the image forming apparatus 100, the stamping mechanism 126 may be disposed downstream of a thermal transfer position (a thermal head) inside the image forming section 124 in the medium conveying direction.

Furthermore, the invention encompasses any possible combination of some or all of the various embodiments and the modification examples described herein and incorporated herein.

It is possible to achieve at least the following configurations from the above-described example embodiments of the invention.

(1) An image forming apparatus, including:

a conveying section configured to convey a medium in a medium conveying direction;

an image forming section configured to form an image on the medium conveyed by the conveying section;

a medium sensor configured to perform detection of the medium conveyed by the conveying section;

a mark printing section configured to perform printing of a mark on the medium conveyed by the conveying section; and a controller configured to cause, based on a result of the detection by the medium sensor, the mark printing section to perform the printing of the mark on the medium, from a timing at which image formation on the medium by the image forming section is completed.

(2) The image forming apparatus according to (1), wherein the mark printing section is disposed downstream of the image forming section in the medium conveying direction.

(3) The image forming apparatus according to (1) or (2), wherein the controller controls, based on the result of the detection by the medium sensor, the mark printing section to perform the printing of the mark on the medium, from a timing at which a rear end in the medium conveying direction of the medium has passed through the image forming section.

(4) The image forming apparatus according to any one of (1) to (3), wherein the image forming section includes a fixing device configured to fix the image formed on the medium, and the mark printing section is disposed downstream of the fixing device in the medium conveying direction.

(5) The image forming apparatus according to any one of (1) to (4), wherein the mark printing section performs the printing of the mark on the medium by stamping the mark on the medium.

(6) The image forming apparatus according to any one of (1) to (5), wherein the mark includes information indicating the completion by the image forming section of the image formation on the medium.

(7) The image forming apparatus according to any one of (1) to (6), wherein the mark includes a page number of the medium.

(8) The image forming apparatus according to any one of (1) to (7), wherein the medium includes a first surface and a second surface that is on opposite side of the first surface, the image is formed on the first surface, and the mark is printed on the second surface.

(9) The image forming apparatus according to (8), wherein the medium includes a label and a mount, the label having the first surface, and the mount having the second surface attached with the label.

(10) The image forming apparatus according to any one of (1) to (9), further including a display section configured to display, based on the result of the detection by the medium sensor, positional information of the medium in the medium conveying direction.

Although the invention has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming apparatus, comprising:

a conveying section configured to convey a medium in a medium conveying direction;

an image forming section configured to form an image on the medium conveyed by the conveying section;

a medium sensor configured to perform detection of the medium conveyed by the conveying section;

a mark printing section configured to perform printing of a mark on the medium conveyed by the conveying section; and a controller configured to cause, based on a result of the detection by the medium sensor, the mark printing section to perform the printing of the mark on the medium, from a timing at which image formation on the medium by the image forming section is completed.

2. The image forming apparatus according to claim 1, wherein the mark printing section is disposed downstream of the image forming section in the medium conveying direction.

3. The image forming apparatus according to claim 1, wherein the controller controls, based on the result of the detection by the medium sensor, the mark printing section to perform the printing of the mark on the medium, from a timing at which a rear end in the medium conveying direction of the medium has passed through the image forming section.

4. The image forming apparatus according to claim 1, wherein the image forming section includes a fixing device configured to fix the image formed on the medium, and the mark printing section is disposed downstream of the fixing device in the medium conveying direction.

5. The image forming apparatus according to claim 1, wherein the mark printing section performs the printing of the mark on the medium by stamping the mark on the medium.

6. The image forming apparatus according to claim 1, wherein the mark includes information indicating the completion by the image forming section of the image formation on the medium.

7. The image forming apparatus according to claim 1, wherein the mark includes a page number of the medium.

8. The image forming apparatus according to claim 1, wherein the medium includes a first surface and a second surface that is on opposite side of the first surface, the image is formed on the first surface, and the mark is printed on the second surface.

9. The image forming apparatus according to claim 8, wherein the medium includes a label and a mount, the label having the first surface, and the mount having the second surface attached with the label.

10. The image forming apparatus according to claim 1, further comprising a display section configured to display, based on the result of the detection by the medium sensor, positional information of the medium in the medium conveying direction.

* * * * *